United States Patent [19]

Noble

[11] Patent Number: 4,483,626

[45] Date of Patent: Nov. 20, 1984

[54] MEDICATION TIMING AND DISPENSING APPARATUS

[75] Inventor: Terrance O. Noble, Rosemount, Minn.

[73] Assignee: Apothecary Products, Inc., Burnsville, Minn.

[21] Appl. No.: 338,015

[22] Filed: Jan. 8, 1982

[51] Int. Cl.[3] ..... G04B 47/00

[52] U.S. Cl. ..... 368/10; 368/73; 368/89; 368/107; 368/276

[58] Field of Search ..... 368/10, 215, 89, 107–109, 368/113, 76, 276, 72–74; 221/2; 340/390.1, 390.4

[56] References Cited

U.S. PATENT DOCUMENTS

| | | | |
|---|---|---|---|
| 1,469,056 | 9/1923 | Sullivan . | |
| 2,394,286 | 2/1946 | Blaisdell | 161/15 |
| 2,497,584 | 2/1950 | Carmichael | 161/4 |
| 2,627,312 | 2/1953 | Haney | 368/276 |
| 2,670,794 | 3/1954 | Gallagher | 161/15 |
| 2,853,182 | 9/1958 | Barnett | 206/38 |
| 2,917,892 | 12/1959 | Bly et al. | 58/21.13 |
| 2,970,226 | 1/1961 | Skelton et al. . | |
| 3,264,454 | 8/1966 | Davis et al. | 235/92 |
| 3,474,617 | 10/1969 | Robinson et al. | 58/16.5 |
| 3,552,115 | 1/1971 | Losert | 58/22.9 |
| 3,882,670 | 5/1975 | Woolley | 58/145 K |
| 4,047,375 | 9/1977 | Wulff | 58/21.13 |
| 4,223,801 | 9/1980 | Carlson | 368/10 |
| 4,258,354 | 3/1981 | Carmon et al. | 221/2 |
| 4,275,384 | 6/1981 | Hicks et al. | 221/2 |
| 4,361,408 | 11/1982 | Wirtschafter | 221/2 |
| 4,367,955 | 1/1983 | Ballew | 368/10 |
| 4,374,622 | 2/1983 | Kashio | 368/74 |
| 4,382,688 | 5/1983 | MacHamer | 368/10 |

FOREIGN PATENT DOCUMENTS

| | | |
|---|---|---|
| 2138730 | 1/1973 | Fed. Rep. of Germany . |
| 2426831 | 1/1976 | Fed. Rep. of Germany . |

*Primary Examiner*—Bernard Roskoski

*Attorney, Agent, or Firm*—Merchant, Gould, Smith, Edell, Welter & Schmidt

[57] ABSTRACT

A medication organizing apparatus comprises a timer module (11) and medication containers (12, 13, 14). The timer module (1) and medication containers (12, 13, 14) include dovetail flanges (31) and dovetail grooves (30) for interconnection thereof. The timer module (11) further includes a time interval selecting means (21), indicator (160, 154), and timing means (210, 228, 234, 242, 222) for producing a signal indicating the end of the selected time interval on a recurring basis.

25 Claims, 13 Drawing Figures

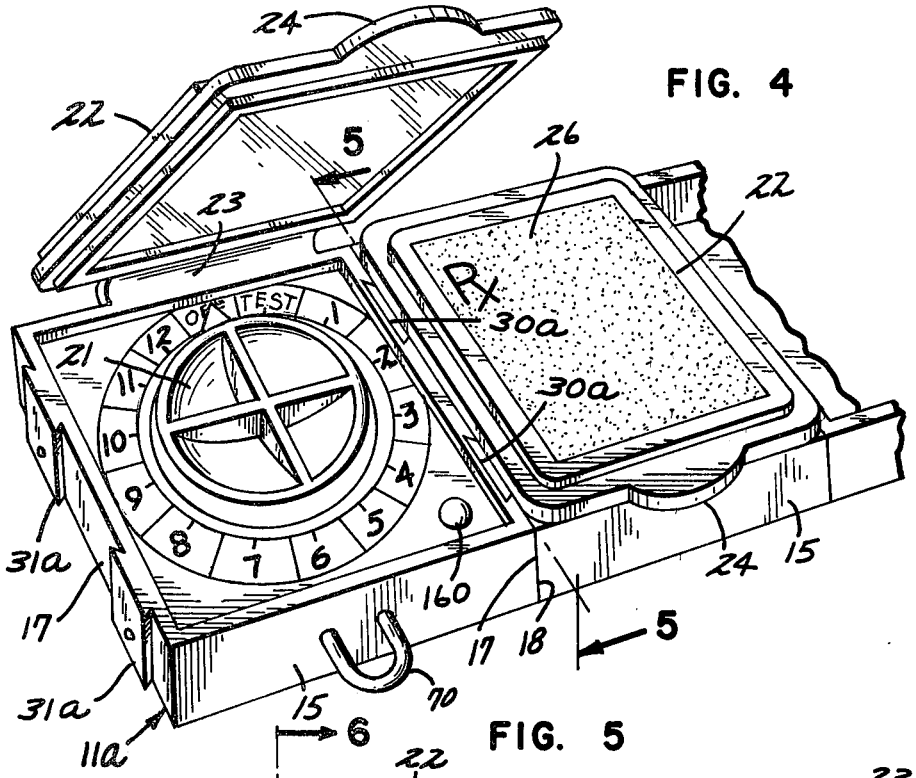
FIG. 4
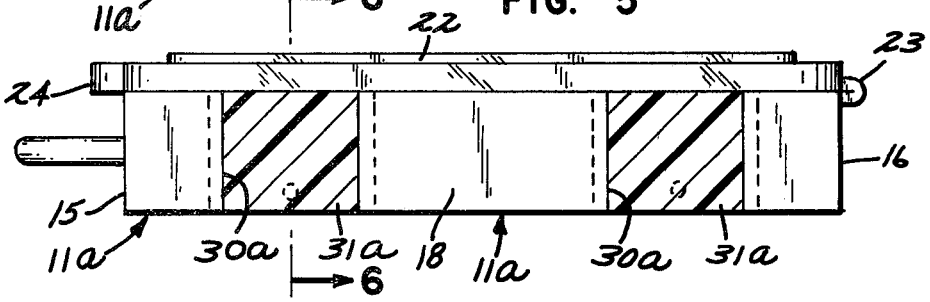
FIG. 5
FIG. 6
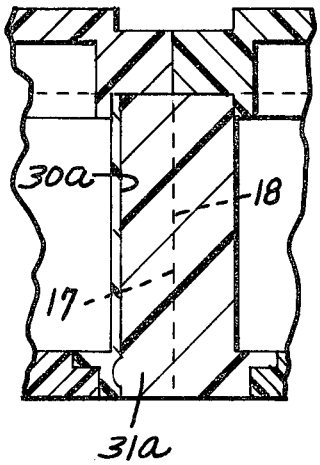
FIG. 7
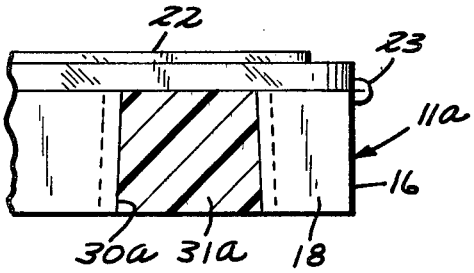

DECODE
TO 140
RESET
IN
Q11
Q12
Q13
Q14
S1
S2
S3
S4
S5
+V

MEDICATION TIMING AND DISPENSING APPARATUS

FIELD OF THE INVENTION

This invention pertains to a timer for reminding a person of a correct intervals for taking pills or other medication, and in particular, this invention pertains to a presettable, repetitive medical timer and a modular pill container system useful in organizing and prompting the taking of prescribed pills or medication.

BACKGROUND OF THE INVENTION

The apparently simple task of remembering the proper times for taking pills or other medication prescribed by a physician can in fact be a very troublesome problem for many patients. For example, if the patient is receiving the medication only on a temporary basis, no habit or pattern of taking pills will have been established, and involvement in other daily activities can easily lead to forgotten or skipped dosages. Even in the case of drug therapy for chronic conditions, problems are encountered if, for example, the patient is on more than one kind of medication, or if the patient is aged. In the case of a number of pills to be taken at different times, there is the additional problem of remembering which pill to take at a given interval, in addition to the basic problem of remembering the intervals themselves. In the case of aged patients, forgetfulness over the proper interval, and perhaps confusion over which of several drugs prescribed for the patient frequently occurs. It is quite common for aged patients to be on a number of different medications for different conditions, and taking the wrong one at the wrong time can lead to unintentional overdose or other dangerous situations.

Various techniques have been used in the past in attempts to deal with this problem, including numbering or color coding of pill boxes, and the use of alarm clocks or other timers as reminders for pill taking. However, despite the many efforts in the prior art, the problem of taking the correct medication at the correct interval has persisted.

SUMMARY OF THE INVENTION

This invention provides an adjustable, repetitive medical timer which helps to overcome the above-noted problems. The timer can be set by the user to the desired time interval between prescribed medication dosages, and the timer then provides an alarm, i.e. tone, beep, flashing light, etc. to inform the patient when the time has come for taking the medication. Upon occurrence of the alarm, the timer automatically begins timing another interval of the same duration without any requirement that the patient restart or reset the timer. The timer thus automatically repeats the successive time intervals, each ending with the alarm indication, for successive medication-taking periods. If necessary, different time intervals can easily be selected by the patient by turning a dial or actuating switches.

According to another aspect of the invention, a modular timer and a pill container system is provided, including pill containers and one or more timers. The medical timer, together with selector switch or switches, and alarm or indicating device is mounted within a container adapted to connect with one or more pill container modules. The connection means may comprise, for example, the dovetail groove configuration along the edges of the timer and pill containers, so that any number or combination of containers and timers can be put together into a system by engaging the dovetails and corresponding grooves on adjacent modules. In this manner the pills and timer can be connected together in a single package for convenience and effectiveness in administering the medication. For patients on multiple types of pills, multiple pill containers and timers can be provided, as can be means for associating the pill container with the corresponding timer.

According to another aspect of the invention, the timer unit can be adapted for wearing as a wrist watch or necklace for ease in portability.

BRIEF DESCRIPTION OF THE DRAWING

In the drawing,

FIG. 4 is a fragmentary view in perspective of a modular timer and container system showing an alternate connecting means for the modules;

FIG. 5 is a view seen from the line 5—5 of FIG. 4 on an enlarged scale;

FIG. 6 is a greatly enlarged sectional view as seen from the line 6—6 of FIG. 5;

FIG. 7 is a fragmentary view similar to a portion of FIG. 5 showing an alternate connection means;

DETAILED DESCRIPTION OF THE PREFERRED EMBODIMENT

Figure 1:
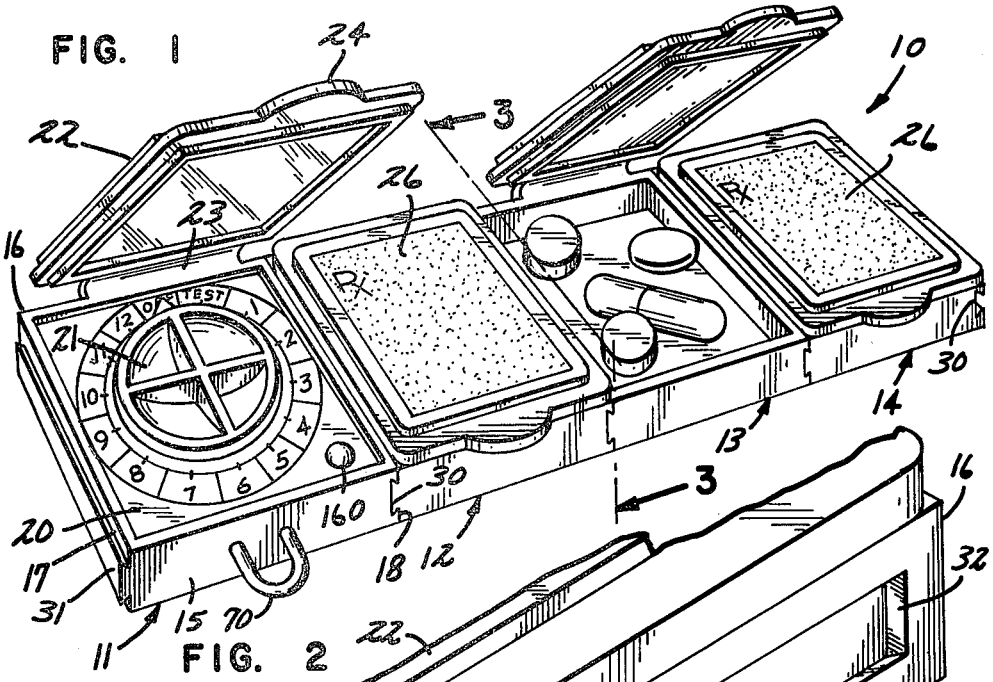
FIG. 1 is a view in perspective of a modular timer and pill container system according to the present invention.
Figure 2:
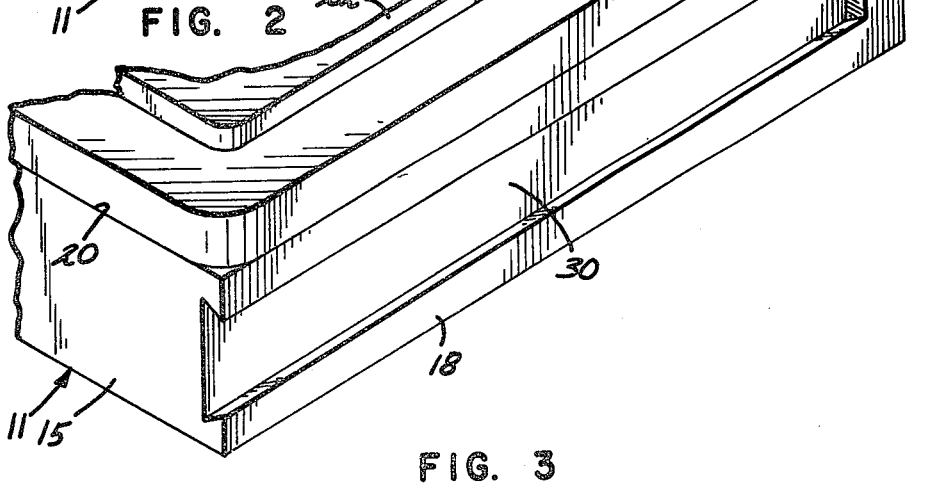
FIG. 2 is a fragmentary view in perspective of a dovetail groove connection along the edge of one of the modular units of the system of FIG. 1, on an enlarged scale.
Figure 3:
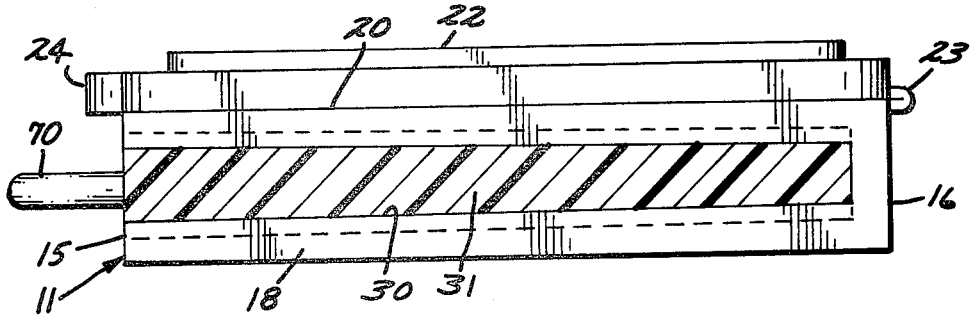
FIG. 3 is a sectional view as seen generally from the line 3—3 of FIG. 1, on an enlarged scale.

Referring to FIGS. 1, 2 and 3, in which identical reference numbers refer to the same parts in the various views, reference number 10 generally designates a modular timer and pill container system according to the present invention. The system shown comprises four modules, one timer module 11 and three pill container modules 12, 13 and 14. It will be understood, however, that any number of timers and pill containers can be connected together in any order, according to one aspect of this invention. In the embodiment shown, each of modules 11–14 comprises a somewhat flattened rectangular housing, having means along adjacent edges for connection to other modules. With reference to timer module 11, its container has a front side 15, and opposite back side 16, and opposing edges 17 and 18. The top or face 20 of timer module 11 includes a control knob or selector switch 21, whose operation will be described more fully hereinafter. A protective cover 22 is provided and is designed to snap in place over face 20. Preferably, cover 22 is transparent on top so that the setting of selector switch 21 can be viewed while the cover is closed. If the casing for the module and the cover are made of high density tough plastic, they can be formed intergrally, with attaching flexible hinge portion 23 connecting them together along one edge.

Pill container modules 12, 13 and 14 similarly are somewhat flattened rectangular containers with hinged snap type covers. Flanged or raised portions around the inside of the covers cooperate with the lower portion of the container to provide a positive snap type closure, as is generally known in the art, and an extension 24 of the cover serves as a pressure point for snapping open the cover with the fingers. In the case of the pill container modules, the top surface 26 is preferably roughened to permit pencilling in the name of the contents, directions, etc.

Each of modules 11–14 has a dovetail slot 30 disposed longitudinally along one edge, and a corresponding dovetail projection 31 along the opposite side, to enable modules to be connected together by sliding the dovetail projection of one into the dovetail slot of the adjacent module. As seen there in FIG. 2, the dovetail slot has a stop or end member 32 which stops the relative movement when the two modules are in place side by side. In additional, both the dovetail slot and the dovetail projection can be tapered from one end to the other to form a wedge as indicated in FIG. 3, to provide a snug fit when the two modules come into alignment, as an aid in holding them together.

The embodiment of FIGS. 4–6 is similar in most respect to the embodiment of FIGS. 1–3, except that the orientation of the dovetail connections has been rotated by 90 degrees to a transverse position, and pairs of elements have been provided. In other respects the embodiment of FIGS. 4–6 is identical to the embodiment of FIGS. 1–3, and identical parts are identically numbered. In FIGS. 4–6, module 11*a* has a pair of dovetail projections 31*a* along its side 17, that are extended vertically with respect to the drawing, as opposed to horizontally as in FIG. 2. The other side, 18 of the module has corresponding vertically dovetail slots 30*a*. In this manner adjacent modules, either timer modules or pill container modules, can be assembled together to form a system in any desired order or number.

As seen in FIGS. 5 and 6, a projection and corresponding recess can be formed respectively in the dovetail slot and projection to serve as a detent to hold the adjacent units in a assembled, aligned position. Alternatively, the dovetail slot and projection can be tapered as indicated at FIG. 7, to provide the necessary force for holding units together.

Figure 8:
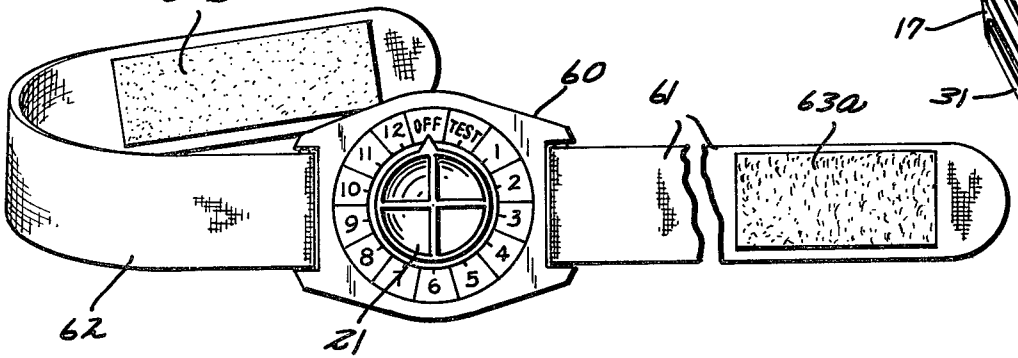
FIG. 8 shows an embodiment of the medical timer adapted to be worn on the wrist.

FIG. 8 shows an alternate embodiment of the medical timer, wherein the timer circuitry is contained in a housing 60 adapted to be worn around the wrist like a wrist watch. Straps 61 and 62 are attached to housing 60 to extend around the wrist and a suitable fastening means, for example patches of hook and pile type fastener 63*a* and 63*b* may be provided. The selector control 21 is mounted on the face of the housing 60 for access and adjustment.

Figure 9:
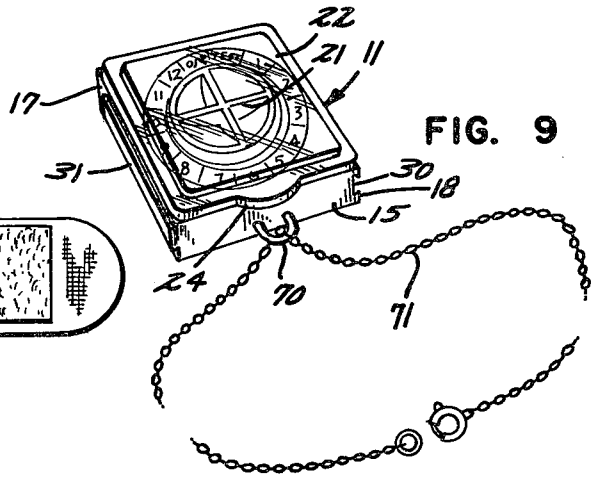
FIG. 9 shows an embodiment of the medical timer adapted to be worn around the neck.

FIG. 9 shows wearing the timer module 11 around the neck as a necklace for convenience. For this purpose a loop 70 or other fasting means is provided along on side, and a chain, string or the like 71 can be attached to or through fastening device 70 for attachment around the neck.

Figures 10, 12:
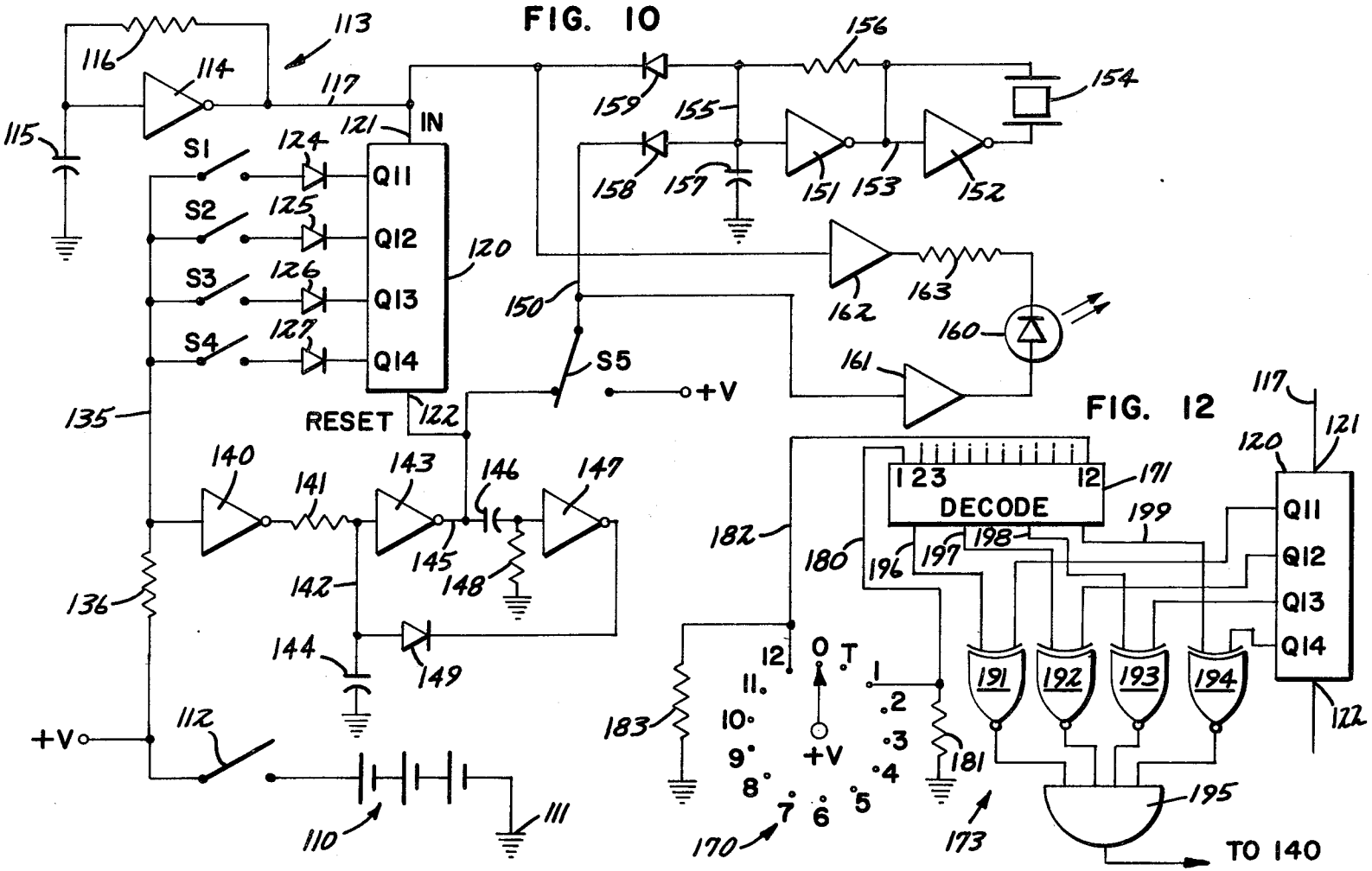
FIG. 10 is an electrical schematic diagram for one embodiment of the medical timer of this invention.
FIG. 12 is an electrical schematic diagram of an alternate embodiment of circuitry for use with the circuitry of FIG. 10.

Referring now to FIG. 10, there is shown a circuit diagram for one embodiment of the automatically repeating timer of the present invention. Reference number 110 indicates three series-connected batteries which provide the operating power for the device. In the preferred embodiment, since long battery life is an important factor, three alkaline cells, Mallory RM 675H or equivalent are used. Of course, depending on the particular circuit design used, the voltage or number of cells can be selected accordingly. The negative side of the power supply connects to signal ground as indicated at reference number 111, and the positive side connects to on-off switch 112, whose other side connects to +V. This power connection and also the signal ground 111 are connected to energize the various active circuit components of the circuit, but these connections are omitted from the figure for purposes of clarity.

An oscillator 113 generates time based signals for the timer. Although any type of oscillator could be used, in the embodiment of FIG. 10 a Schmitt trigger 114 is used, in conjunction with a capacitor 115 which connects from its input to signal ground, and a feedback resistor 116 which connects from the output to the input of the Schmitt trigger. For efficiency and economy reasons, Schmitt trigger 114 is a CMOS device, part of an integrated circuit package in common with the other Schmitt triggers in the circuit of FIG. 12.

Reference number 120 refers to a fourteen bit binary counter, which is also preferably a CMOS integrated circuit. It has a count input 121 which receives lead 117 from the output of oscillator 113, and a reset input 122. Binary counter 120 has a number of outputs corresponding to the various stages of the counter. In the embodiment of FIG. 2, outputs for the first ten stages are not used, but the last four stages, designated Q11 through Q14 are used in connection with the logic for time interval selection. Specifically, output Q11 of the eleventh stage connects to the cathode of a diode 124. Outputs Q12–Q14 of the twelfth through fourteenth stages, respectively, similarly connect to the cathodes of diode 125 through 127, respectively. Each of these diodes connects to one terminal of a single pole, single throw switch S1 through S4, respectively. The other terminals of switches S2 through S4 are connected to a lead 135. A resistor 136 connects from lead 135 to +V, the voltage supply.

Lead 135 also connects to the input of a Schmitt trigger circuit 140, whose output connects through a resistor 141 to a lead 142, a branch of which connects to the input of another Schmitt trigger 143. A capacitor 144, connects from lead 142 to signal ground. The output of Schmitt trigger 143 connects via lead 145 and a capacitor 146 to the input of another Schmitt trigger 147. A resistor 148 connects from the input of Schmitt trigger 147 to signal ground. A diode 149 is connected with its anode to lead 142, and its cathode to the output of Schmitt trigger 147.

A branch of lead 145 connects to the reset input 122 of counter 120, and another branch of lead 145 connects to one terminal of a single pole double throw switch S5. The other terminal of switch S5 connects to +V, and the pole of switch S5 connects to a lead 150.

A pair of Schmitt triggers 151 and 152 are provided, with the output of trigger 151 connecting to the input of trigger 152 via a branch of lead 153. The output of Schmitt trigger 152 connects to one terminal of a piezoelectric alarm tone producing element 154, the other side of which connects to a branch of lead 153. The input of Schmitt trigger 151 is provided by lead 155. Resistor 156 connects between lead 155 and lead 153, and capacitor 157 connects from lead 155 to signal ground. A pair of diodes 158 and 159 have their anodes connected to lead 155. The cathode of diode 158 connects to branch of lead 150, while the cathode of diode 159 connects to lead 117.

An indicating light-emitting diode 160 is provided, and is positioned as indicated in FIG. 1 to be visible on the face of the timer module. LED 160 is driven through branches of leads 150 and 117, through buffer amplifiers 161 and 162 and resistor 163.

In operation, oscillator 113 provides an output signal which is applied to the input of counter 120. In the embodiment shown, capacitor 115 and resistor 116 are selected so that the period of the signal produced is 3.515 seconds. The Q outputs of counter 120 are normally at a logical low level, and go high whenever their respective output count is reached. Counter 120 counts the input signal down in binary fashion, so that with an input period of 3.515 seconds, the Q11 output changes states every hour. Similarly, the Q12 stage changes states every two hours, the Q13 output every four hours, and the Q14 output every eight hours.

The above-mentioned outputs of counter 120 together with diodes 124–127, switches S1–S4 and resistor 136 provide a logical AND function for selecting the timed interval.

In use, one or more of the switches S1–S4 are closed according to the desired timing interval. It will be appreciated that the time values or weights for the switches increase in binary sequence with successive switches having double the time value of the preceding one. For example, if a six hour timing interval is desired, switches S3 (4 hours) and S2 (2 hours) would be closed with the others remaining open. If a twelve hour interval were desired, switches S4 (8 hours) and S3 (4 hours) would be closed, and so on to give the desired timing interval anywhere from one hour (S1) up to a maximum of 15 hours for the embodiment shown. Of course the minimum intermit could be smaller by using one or more of the earlier output stages of counter 120 in conjunction with additional diodes and switches. Longer time intervals could similarly be provided by one or more additional higher count stages.

So long as at least one of the outputs Q11 through Q14 whose corresponding switch S1 through S4 is closed is at a logical low signal, the alarm will not sound. The alarm will sound only when all of the outputs Q11 through Q14 whose switches are closed go to a high logic level.

When switch 112 is closed, a timing interval is begun. Counter 120 begins to accumulate counts from the oscillator, but until the selected count as determined by the position of switches S1–S4 is reached, the alarm will not be energized. During this interval, one or more of the selected outputs Q11–Q14 will be at a logical low level, thus establishing a current path from +V to resistor 136, through the corresponding ones of the time selector switches and diodes to the output or outputs that are low. The current flow results in a logic low level at lead 135, at the input to Schmitt trigger 140. When the selected time is reached, by definition all of the selected outputs will reach a high logic level, removing the current path and creating a high input to Schmitt trigger 140.

Schmitt triggers 143 and 147 and associated components comprise a one-shot circuit, having a ten second time period in the preferred embodiment. When the selected time interval is reached and Schmitt trigger 140 is energized, a one-shot circuit is energized putting a logical one on lead 145 for the duration of the ten second interval. This logical one resets counter 120 and holds it in the reset mode until the end of the ten second interval. At the same time, the logical one at lead 145 removes the ground signal previously clamping the input of Schmitt trigger 151 through diode 158, and allows it to oscillate at the audio frequency of approximately two to three kilohertz. The output of amplifier 151 is applied to Piezoelectric element 154, and the signal is inverted by amplifier 152 and applied to the other terminal to operate the Piezoelectric element in push pull fashion, causing it to generate the audible alarm tone. Diode 159 and the time base signal at lead 117 from the oscillator serve as a further clamp to alternately enable and inhibit the generation of the audible tone. The net result is that when the selected time interval is reached, tone bursts or beeps are produced having a duration of approximately 1.7 seconds and these tone bursts or beeps are repeated for the ten second interval. When this ten second period is up, the logical one at lead 145 is removed, inhibiting Schmitt trigger 151 from generating further audible signals. The reset pulse from input 122 is removed, and counter 120 is allowed to begin again the accumulation of pulses leading eventually to the generation of another series of tone bursts when the selected time interval is again reach. Thus, it will be seen that upon occurrence of the alarm, the timer automatically begins timing another interval of the same duration without any requirement that the patient restart or reset the timer.

When the tone alarm is actuated, LED 160 is also made to flash. The flashing of LED 160 will help to identify which timer has timed out its interval, in case more than one timer is being used by a person who is taking more than one type of medication. For example, if a plurality of timers and corresponding pill boxes are connected together into a system as in FIG. 1, with the different timers set to different time intervals corresponding to the prescription for that particular medication when a beeper goes off, the patient simply has to look to see which LED is flashing to identify the timer module. Then, by prior written notes, color coding, etc. associating the timer with its corresponding pill container, the patient is immediately informed that it is time to take the particular medication.

A test function is provided by switch S5. Actuating of this switch connects lead 150 to the +V supply, and results in production of tone bursts and flashing of the indicator light in the manner previously described, for as long as the switch is engaged. This allows the user to confirm the operativeness of the battery and alarm circuitry.

Figure 11:
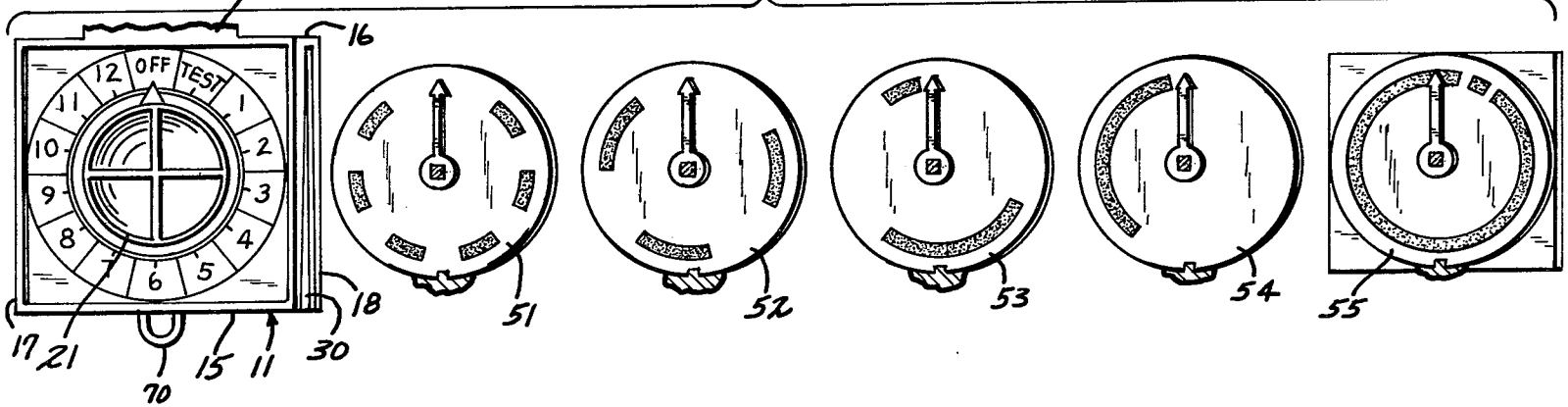
FIG. 11 is a schematic representation of a multiple sections control switch for use in one embodiment of the timer.

Since the operation of the time selector switches in the embodiment of FIG. 10 involves a binary sequence whose values must be summed to get the desired time, it might be desirable to have a selector switch which would allow direct selection of the desired time interval. Such a selector switch is indicated in FIG. 11 and the indicator for which is shown in FIGS. 1, 4, 8 and 9. The switch can be a multiple segment switch as suggested in FIG. 11. Separate switch segments 51–55 are provided to accomplish the functions of S1–S4, and have conductive patterns at various positions to in effect convert selector switch positions 1 through 12 into the corresponding binary code for use in conjunction with counter 120 and the previously described circuitry to select the desired time interval. For example, if selector switch 21 is turned to "three", the switch sections 51 and 52 corresponding to S1 and S2 would be closed while 53 and 54 corresponding to S3 and S4 would be open, giving a weighted time value of three hours in the circuit of FIG. 10. In addition, a switch segment 55 can be provided corresponding to S5 to perform the test function previously described.

As an alternative to the mechanical multisegment switch of FIG. 11, a single pole rotary selector switch and the decoder logic of FIG. 12 can be used. In FIG. 12, switch 170 is provided and would be operated by selector 21 on the face of the timer module as in FIG. 1, etc. Switch 170 is a single pole multiposition switch, in which the pole would be connected to +V. In FIG. 12, counter 120 is shown, and would be connected to oscillator 113 and reset 122 as in FIG. 10. However, its outputs Q11 through Q14 would connect to a logic circuit 173 comprising exclusive-NOR-gates 191–194 and AND-gate 195.

Each of the four switch terminals of switch 170 connects to a decimal to binary decoder 171 having at least twelve inputs, representing one hour through twelve hours. The one hour terminal connects via lead 180 to one input of decoder 171. Each of the other terminals of switch 170 would connect to another input, but these have been omitted for purposes of clarity, and only the final lead 182 is shown, which connects the twelve hour terminal to decoder 171. Specifically, lead 180 connects from the one hour terminal of switch 170 to the first input of decoder 171. A resistor 181 may be provided from lead 180 to signal ground, to hold the input to decoder 171 at a logical zero when the one hour position is not selected. Lead 182 connects from the twelve hour terminal of switch 170 to the twelfth input of decoder 171, and a resistor 183 similarly connects to signal ground. The outputs of decoder 171 are connected through leads 196–199 to gates 191–194 respectively. The output of gate 195 can connect to the input of Schmitt trigger 140 of FIG. 10. Of course diodes 124–127, switches S1–S4, lead 135 and resistor 136 would not be used when using the embodiment of FIG. 12.

Turning switch 170 to the desired hour timing interval places a logic one on the corresponding input of decoder 171 connected to that terminal. In response thereto, decoder 171 outputs through leads 196–199 to gates 191–194 the 4-bit binary code corresponding to the selected input. As counter 120 accumulates counts, the count outputs are applied to the corresponding inputs of gates 191–194. When the count reaches the preselected interval as determined by the setting of switch 170, matching logic inputs are applied to the corresponding exclusive-NOR gate, causing its output to go to a logical one. The output of AND-gate 195 then goes high, and the alarm sequence described previously with respect to FIG. 10 is initiated.

Figure 13:
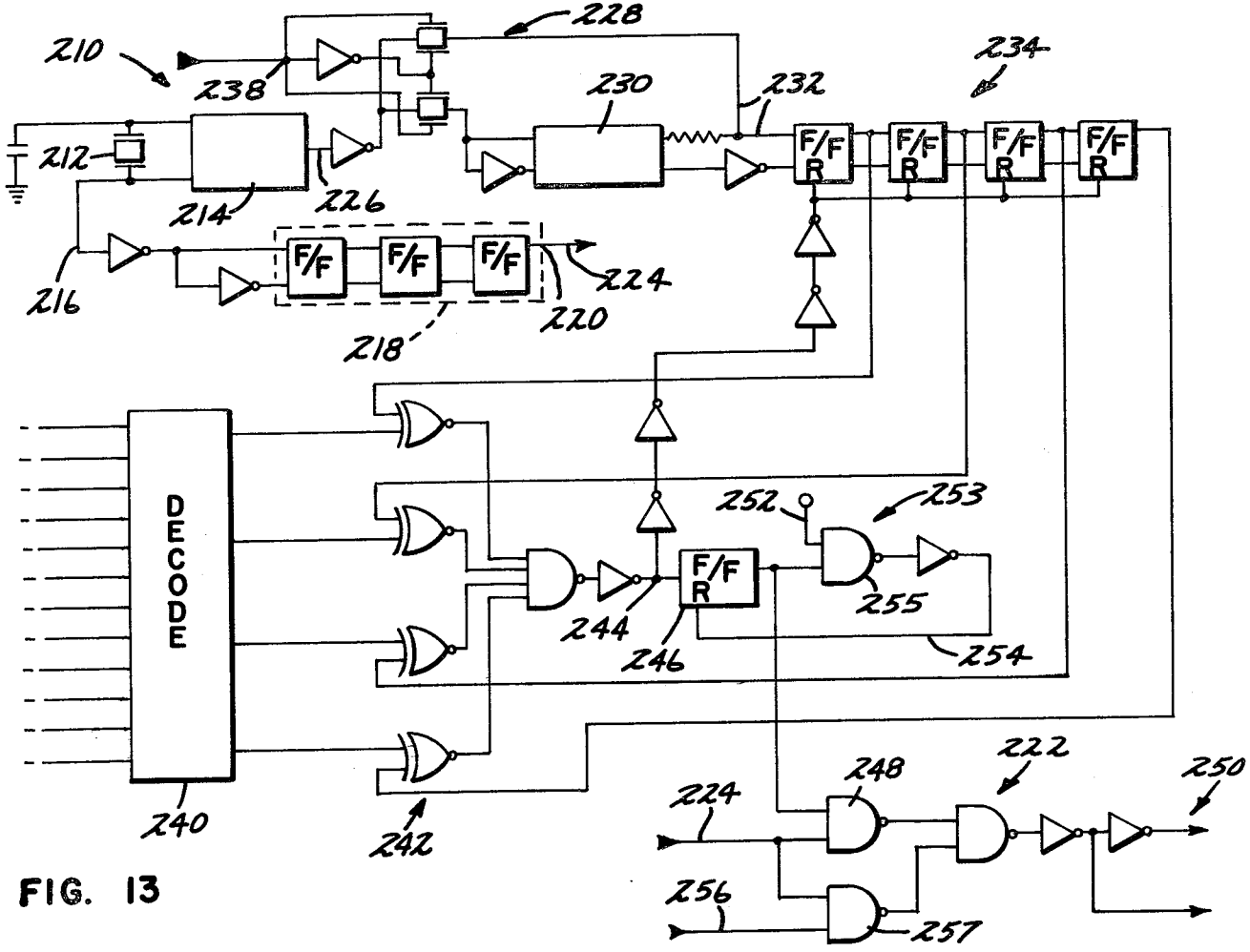
FIG. 13 is an electric schematic diagram for a preferred embodiment of the medical timer of this invention.

Referring to FIG. 13 there is shown the preferred embodiment of the present invention. Oscillator circuit 210, which serves a purpose similar to oscillator 113 illustrated in FIG. 10, includes a crystal 212 connected to a biasing and frequency divider circuit 214. An output is tapped from oscillator 212 on conductor 216 for input to divide-down circuit 218, which produces at output 220 a signal having a frequency in the range of 4 kilohertz for oscillating the Piezoelectric alarm element in the audible range. It will be understood that other audible frequencies, lower or higher than 4 kilohertz, could be utilized. Output 220 is connected to conductor 224 for input to transducer drive circuitry 222.

Connected to crystal 212 is circuit 214, which produces a ½ hertz signal on conductor 226 for input to complementary switches 228. During normal timing operation and the ½ hertz signal is passed through one of the switches 228 and divided down in circuits 230 to produce a signal having a period of one hour on conductor 232. Counter circuit 234 receives the signal and produces binary coded timing signals for input to circuit 242. Conductor 232 and circuit 234 correspond in function to the respective conductor 117 and circuit 120 shown in FIG. 12. In a test mode of operation, the signal present on conductor 226 is passed through one of the switches 228 directly to conductor 232, bypassing circuit 230 and providing a counter input to circuit 234 at a much accelerated period of 2 seconds, allowing the operation of the timing circuits to be quickly verified. Switches 228 are operated in response to the signal present on conductor 238, which may be connected to a user-controlled switch.

Decode circuit 240 and logic circuit 242 correspond in function and design to circuits 171 and 173 (FIG. 12) respectively, with circuit 240's input connectable as illustrated with respect to circuit 171 in FIG. 12. Circuits 240 and 242 provide for activation of alarm circuit 222 through conductor 244 and alarm duration timing circuit 253. When an alarm activating signal appears on conductor 244 flip-flop 246 is set, producing an enabling signal at gate 248. The oscillator drive signal present on conductor 224 may then drive the Piezoelectric alarm via outputs 250. Though not shown, the enabling signal generated by flip-flop 246 may also be used to actuate an LED, as inverter 143 of FIG. 10 does. In a like manner to the one-shot circuit of FIG. 10, a 1/16 hertz signal, preferably obtained from an intermediate stage of circuit 218, provides a reset signal to flip-flop 246 through conductor 252, gate 255 and conductor 254 at the end of a 16-second period which begins in synchronism with the alarm activating signal on conductor 244.

Further means for activating the Piezoelectric alarm element is provided for by test input 256 and gate 257, allowing user verification of battery condition, and the operation of the Piezoelectric alarm element (154).

It will thus be seen that the invention provides an improved system for organizing and administering pills or other medication, including a selectable interval automatically repeating timer with alarm reminder, and a modular system including timers and pill containers.

What is claimed is:

1. A medication organizing apparatus for holding medication and timing prescribed dose intervals, comprising:

a timer comprising rotatable selector dial means for selecting one of a plurality of numerically indicated predetermined time intervals and decoding a selected interval to binary code, digital timing means responsive to said selector dial means binary code for timing a selected predetermined time interval, indicating means responsive to said timing means for indicating the end of said time interval, means for restarting said timing means at the end of said interval to time another predetermined time interval;

a pocket-sized housing and means mounting said timer in said housing; and a housing for containing medication and removably interconnected with said timer housing.

2. A medication organizing apparatus according to claim 1 wherein said housings are interconnected with complementary dovetail flange and dovetail groove on said housings.

3. A medication organizing apparatus according to claim 2, wherein each of said housings includes a dovetail flange on one side and a dovetail groove on the opposite side thereof so that a plurality of said housings may be connected together.

4. A medication organizing apparatus according to claim 3, wherein said housings are rectangular and wherein said flanges and grooves are disposed longitudinally on the sides thereof.

5. A medication organizing apparatus according to claim 3, wherein said housings are rectangular and wherein said flanges and grooves are disposed transversely on the sides thereof.

6. A medication organizing apparatus according to claim 2, further including a stop member whereby said housings may be attached and aligned in a side by side relationship.

7. A medication organizing apparatus according to claim 6, wherein said stop member comprises an occlusion of said dovetail groove near one end thereof so that one end of said dovetail flange abuts said occlusion when said flange is fully inserted in said groove.

8. A medication organizing apparatus according to claim 2 or 3, wherein said dovetail flanges and grooves are tapered to form wedges so that said flanges wedge in said grooves to secure said housings together.

9. A medication organizing apparatus according to claim 1, wherein each of said housings includes a lid and means for flexibly connecting said lid to said housings.

10. A medication organizing apparatus according to claim 9 wherein said timer housing includes a lid having a transparent face so that said timer may be viewed when said lid is closed.

11. A medication organizing apparatus according to claim 1 wherein said housings are constructed from a resilient plastic material.

12. A medication organizing appartus according to claim 9 wherein said container housing lids include a roughened surface for receiving written indicia describing the contents of said containers.

13. A medication organizing apparatus according to claim 9 or 12 wherein said lids are formed integrally with said housings to provide flexible hinge means and further including means for latching said lid means to said container housing.

14. A medication organizing apparatus according to claim 1, wherein said timer housing includes means for connection to a chain or string so that said timer may be disposed around a patient's neck.

15. A medication organizing apparatus according to claim 3, wherein said timer housing includes means for attaching to a wrist band so that said timer may be worn on a wrist.

16. A medication organizing apparatus for holding medications and timing prescribed dose intervals, comprising:

a timer comprising mechanically operated selecting means movable between a plurality of positions for selecting one of a plurality of predetermined time intervals, timing means for converting a position of said selecting means to a binary code and for timing a selected predetermined time interval, indicating means responsive to said timing means for indicating the end of said time interval, means for restarting said timing means at the end of said interval;

a rectangular housing and means mounting said timer in said housing, one side of said housing including a dovetail flange and the opposite side including a dovetail groove, the top of said housing comprising a flexibly hinged lid with transparent face for viewing of said timer and including a latching means integral with said lid and said housing for closing said lid;

a rectangular housing for containing medications, one side including a dovetail flange and the opposite side including a dovetail groove, the top comprising a lid flexibly hinged to said housing and including a roughened surface for receiving written indicia describing the contents of said housing, said lid further including latching means integral therewith for latching to said housing when closed, said timer housing and said medication housing removably connected by mating of said dovetail flanges and grooves, whereby a plurality of said housings may be connected together.

17. An apparatus according to claim 16 wherein said timer housing includes means for connection to a chain or string so that said timer may be disposed around the patient's neck.

18. An apparatus according to claim 16 wherein said timer housing includes means for connection to a wristband so that said timer may be worn on a wrist.

19. A medication organizing apparatus for holding medications and timing prescribed dose intervals, comprising:

a digital timer for producing a signal indicating the end of a preselected time interval on a recurring basis, said timer including mechanical selector dial means for selecting one of a plurality of numerically indicated predetermined time intervals, means for decoding a selected interval to binary code, digital timing means responsive to said binary code for timing a selected time interval, indicating means responsive to said timing means for indicating the end of said time interval, and means for restarting said timing means at the end of said interval to time another predetermined time interval;

a rectangular housing and means mounting said timer in said housing, one side of said housing including a dovetail flange and the opposite side including a dovetail groove, the top of said housing comprising a flexibly hinged lid with transparent face for viewing of said timer and including a latching means integral with said lid and said housing for closing said lid; and a rectangular housing for containing medications, one side including a dovetail flange and the opposite side including a dovetail groove, the top comprising a lid flexibly hinged to said housing and including a roughened surface for receiving written indicia describing the contents of said housing, said lid further including latching means integral therewith for latching to said housing when closed, said timer housing and said medication housing removably connected by mating of said dovetail flanges and grooves, whereby a plurality of said housings may be connected together.

20. A medical timer for timing prescribed dose intervals, comprising:

a housing;

mechanically operated selector dial means including a rotary switch axially mounted in said housing for rotational movement and including a pointer, said switch positionable to point to any one of a plurality of numerically indicated settings each corresponding to a different predetermined dose interval;

means responsive to the position of switch for decoding a selected interval to a corresponding binary code;

digital timing means responsive to said binary code for timing a selected dose interval;

indicating means responsive to said timing means for indicating the end of said dose interval;

means for automatically restarting said timing means at the end of said interval to time another predetermined dose interval.

21. A medical timer according to claim 20 wherein said rotary switch includes a knob mounted in a substantially flush relationship with the surface of said housing.

22. A medical timer according to claim 20 further including test circuit means activated by said rotary switch and responsive at least to the battery voltage to indicate the operability of the timer.

23. A medical timer for timing prescribed dose intervals comprising:

a housing;

a mechanically operated rotary switch axially mounted in said housing for rotational movement between any one of a plurality of settings, each of said settings corresponding to a different numerically indicated dose interval;

a clock for producing marking signals indicative of the passage of a constant time increment;

translator means responsive to the position of said switch for translating a setting into a digital code representative of the number of said time increments comprising the dose interval corresponding to said setting;

counting means receiving said marking signals and said digital code for continuously counting said marking signals and producing an alarm start signal each time the number of time increments represented by said digital code elapse;

indicator means electrically connected to said counting means and responsive to said alarm start signal for indicating to a patient that a medication dose is due or overdue whereby said timer automatically and without operator intervention periodically signals that a medication dose should be taken.

24. A medical timer according to claim 21 wherein said knob is generally concave to provide a cavity extending into said housing and wherein means for gripping and turning the knob are positioned in the cavity thereof.

25. A medical timer according to claim 22 wherein said rotary switch is rotatable to an off setting to deactivate the timer and wherein a test setting is provided to activate said test circuit means and is located between said off setting and said numerically indicated dose interval settings to cause said timer to be tested when said switch is rotated from said off setting and through said test setting to a dose interval setting.

* * * * *